US009575433B2

(12) United States Patent
Kishi

(10) Patent No.: US 9,575,433 B2
(45) Date of Patent: Feb. 21, 2017

(54) IMAGE FORMING APPARATUS HAVING VOLTAGE APPLICATION TO REGULATING MEMBER AND DEVELOPER CARRIER

(71) Applicant: CANON KABUSHIKI KAISHA, Tokyo (JP)

(72) Inventor: Yosuke Kishi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/838,506

(22) Filed: Aug. 28, 2015

(65) Prior Publication Data

US 2016/0062266 A1 Mar. 3, 2016

(30) Foreign Application Priority Data

Sep. 1, 2014 (JP) ..... 2014-176947

(51) Int. Cl.
*G03G 15/08* (2006.01)
*G03G 15/06* (2006.01)

(52) U.S. Cl.
CPC ..... *G03G 15/0818* (2013.01); *G03G 15/065* (2013.01); *G03G 15/0806* (2013.01); *G03G 2215/0653* (2013.01)

(58) Field of Classification Search
CPC ..... G03G 15/0818; G03G 15/065; G03G 15/0806; G03G 2215/0651; G03G 2215/0653
USPC ..... 399/55, 279, 285
See application file for complete search history.

(56) References Cited

U.S. PATENT DOCUMENTS 5,245,391 A * 9/1993 Suzuki ..... G03G 15/0806 399/285
6,751,423 B2 * 6/2004 Sakaizawa ..... G03G 15/0812 399/284
7,844,200 B2 11/2010 Kanai et al.
(Continued)

FOREIGN PATENT DOCUMENTS

JP H09-197803 A 7/1997
JP 3162219 B2 4/2001
(Continued)

*Primary Examiner* — Robert Beatty
(74) *Attorney, Agent, or Firm* — Fitzpatrick, Cella, Harper & Scinto

(57) ABSTRACT

An image forming apparatus includes a developing apparatus having a container for storing a developer, a developer carrier in which a surface that carries the developer is configured so that a plurality of dielectric portions is interspersed on a surface formed of a conductor portion, and a regulating member that regulates a layer thickness of the developer that is carried on the developer carrier. In addition, a voltage applying unit applies voltages to the developer carrier and the regulating member. The voltage applying unit has a period, during non-image formation, over which voltages are applied to the developer carrier and the regulating member, with an absolute value of potential difference between the applied voltages being greater than that when a voltage is applied during image formation to at least one of the developer carrier and the regulating member, such that a force generated to attract the developer toward the developer carrier during non-image formation is weaker than that generated during image formation.

11 Claims, 8 Drawing Sheets

(56) References Cited

U.S. PATENT DOCUMENTS

| | | | | |
|---|---|---|---|---|
| 2007/0053707 | A1* | 3/2007 | Ream | G03G 15/0812 399/55 |
| 2009/0080921 | A1* | 3/2009 | Shimizu | G03G 15/0812 399/55 |
| 2013/0223891 | A1* | 8/2013 | Koyanagi | G03G 15/0818 399/279 |

FOREIGN PATENT DOCUMENTS

| | | | |
|---|---|---|---|
| JP | 3272056 | B2 | 4/2002 |
| JP | 2005326538 | A * | 11/2005 |

* cited by examiner

IMAGE FORMING APPARATUS HAVING VOLTAGE APPLICATION TO REGULATING MEMBER AND DEVELOPER CARRIER

BACKGROUND OF THE INVENTION

Field of the Invention

The present invention relates to an image forming apparatus using an electrophotographic scheme.

Description of the Related Art

Developing assemblies in which a developer feed/stripping member is omitted have been proposed in order to reduce the size and lower the cost of developing assemblies of image forming apparatuses. Developer feed/stripping members have the function of supplying and stripping a developer (toner) to/from a developing roller (developer carrier). Developer feed/stripping members are used mainly as countermeasures against ghosting, solid image tracking defects and toner melt adhesion.

Herein, ghosting denotes a phenomenon where, upon formation of a halftone image following formation of a solid image of high density, vestiges of the solid image are visible on the halftone image. Solid image tracking defects are a phenomenon where the density at the trailing end of the image drops, and which occur when a 100% solid image is drawn over the entirety of the image. Toner melt adhesion is a phenomenon where every time that an image formation operation is performed, the toner on the developing roller is not replaced but remains therefor a long time. This is exacerbated with repeated rubbing, and, eventually, the toner becomes fixed to the surface of the developing roller. In order to omit a developer feed/stripping member, therefore, the above problems need to be dealt with by resorting to some other means.

Accordingly, developing assemblies from which a developer feed/stripping member has been scrapped have been proposed wherein the surface of the developing roller is configured to have dielectric portions and conductor portions that are distributed, mixed with each other regularly or irregularly, over the surface of the developing roller (Japanese Patent Nos. 3272056 and 3162219). Specifically, a developer regulating member rubs the dielectric portions of the developing roller surface, directly or via toner, so that, as a result, the dielectric portions become charged, and small closed electric fields are formed on portions, of the dielectric portions, adjacent to the conductor portions. Toner having been transported onto the developing roller surface is acted upon by gradient forces derived from the small closed electric fields. The toner is drawn thereby onto the developing roller surface, to be carried thereon.

In toner supply by gradient forces, however, the attraction force of the developing roller towards the toner may in some instances be stronger than in cases where a developer feed/stripping member is used, and toner melt adhesion may occur.

Technologies proposed for suppressing occurrence of toner melt adhesion in developing rollers that exploit gradient forces include methods that involve forming a predetermined potential difference during non-image formation, to cause thereby toner on the developing roller to migrate to a developer feed/stripping member (Japanese Patent Application Publication No. H09-197803). Specifically, schemes have been disclosed that involve forming a potential difference such that toner on the developing roller is attracted towards the developer feed/stripping member, to electrically strip off the toner on the developing roller.

In such a technology, however, a developer feed/stripping member has to be provided in order to electrically attract toner on the developing roller. This constitutes an impediment to reductions in size and cost.

SUMMARY OF THE INVENTION

The image forming apparatus according to the present invention, comprising a developing apparatus including:

a container that holds a developer;

a developer carrier in which a surface that carries the developer is configured so that a plurality of dielectric portions is interspersed on a surface formed of a conductor portion; and a regulating member that regulates a layer thickness of the developer that is carried on the developer carrier, the image forming apparatus forming an image on a recording material by developing, using the developing apparatus, an electrostatic latent image formed on an image bearing member to yield a developer image, and transferring the developer image from the image bearing member to the recording material, the image forming apparatus further comprising:

voltage applying unit for applying voltages to the developer carrier and the regulating member, wherein the voltage applying unit has a period, during non-image formation, over which voltage such that an absolute value of potential difference between voltage applied to the developer carrier and voltage applied to the regulating member is greater than that during image formation is applied to at least one of the developer carrier and the regulating member.

Further features of the present invention will become apparent from the following description of exemplary embodiments (with reference to the attached drawings).

DESCRIPTION OF THE EMBODIMENTS

Modes for carrying out the present invention will be exemplarily explained next in detail on the basis of embodiments, with reference to accompanying drawings. The dimensions, materials and shapes of the constituent parts, relative arrangement between the constituent parts, and other features described in the following embodiments are to be modified, as appropriate, in accordance with the configuration of the equipment to which the present invention is to be applied, and in accordance with various other conditions. That is, the purport of such features does not limit the scope of the invention to the disclosure that follows hereafter.

Embodiment 1

Figure 1:
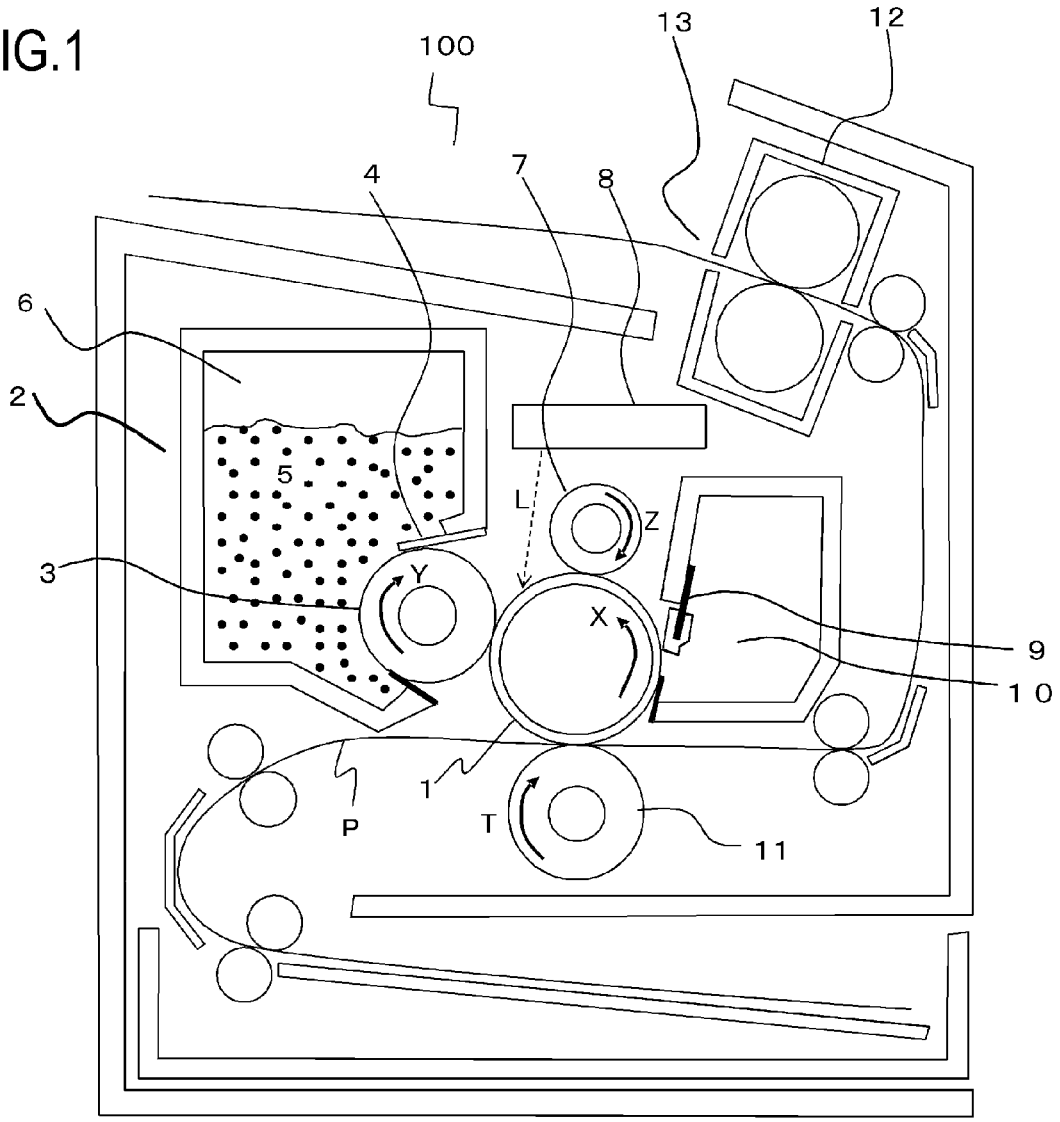
FIG. 1 is a schematic cross-sectional diagram of an image forming apparatus according to an embodiment of the present invention.

FIG. 1 is a schematic cross-sectional diagram illustrating the schematic configuration of an image forming apparatus 100 according to an embodiment of the present invention. Herein, the term "image forming apparatus" (electrophotographic image forming apparatus) refers to an apparatus in which an image is formed on a recording material (recording medium), by a developer (toner), in accordance with an electrophotographic image formation process. Examples of the image forming apparatus include, for instance, electrophotographic copiers, electrophotographic printers (LED printers, laser printers and the like), electrophotographic fax machines and electrophotographic word processors, as well as multifunction machines (multifunction printers) of the foregoing. The term "recording material" denotes a material on which an image is formed, for instance recording paper, OHP sheets, plastic sheets, fabrics and the like.

A photoconductor drum 1 as an image bearing member, having an outer diameter of 24 mm, is rotationally driven in the direction of arrow X, at a peripheral speed of 150 mm/sec. Around the photoconductor drum 1 there are disposed, for instance, a charging roller 7 as charging means, an exposure device 8 for forming an electrostatic latent image on the photoconductor drum 1, and a developing apparatus 2, as developing means, for developing, as a toner image (developer image), the electrostatic latent image having been formed on the photoconductor drum 1. The charging roller 7 rotates in the direction denoted by arrow Z, following the photoconductor drum 1, and has charging bias applied thereto by a charging bias power source device (not shown). In the exposure device 8, a semiconductor laser (not shown) emits light in accordance with an image signal that corresponds to an input signal, the emitted laser light passes through a polygon mirror (not shown) or an imaging lens group (not shown), and is irradiated, in the form of laser light L, onto the photoconductor drum 1. An electrostatic latent image becomes formed thus on the photoconductor drum 1. The electrostatic latent image formed on the photoconductor drum 1 is developed, in the form of a toner image, by the developing apparatus 2.

The image forming apparatus 100 is provided with a transfer roller 11, as transfer means for transferring, onto a recording material P, the toner image having been formed on the photoconductor drum 1. The transfer roller 11 rotates in the direction of arrow T, and has transfer bias applied thereto by a transfer bias power source device (not shown). The image forming apparatus 100 is provided with a fixing apparatus 12 for fixing, to the recording material P, the toner image that has been transferred to the recording material P. The recording material P having been passed through the fixing apparatus 12 is outputted through an output port 13. Residual toner 5 that has not been transferred to the photoconductor drum 1 during the transfer process is scraped off the photoconductor drum 1 by a cleaning blade 9. The photoconductor drum 1, the surface of which has been thus brought again to a clean state, goes on to be used in a subsequent image formation operation. The scraped toner is held in a waste toner holding portion 10.

In the present embodiment, the photoconductor drum 1, the charging roller 7, the cleaning blade 9, the waste toner holding portion 10 and the developing apparatus 2 are integrated together in the form of a process cartridge. The process cartridge is configured to be attachable and removable to/from the body of the image forming apparatus 100. The term "apparatus body" refers herein to a constituent part that results from excluding the process cartridge from the image forming apparatus 100. As illustrated in FIG. 1, the developing apparatus 2 of the present embodiment is provided with the developer container 6, a developing roller (developer carrier) 3, and a developing blade (regulating member) 4. The developer container 6 holds the toner 5, being a non-magnetic one-component developer. The developing roller 3 is rotationally driven in the direction of arrow Y, at 180 mm/sec. In the present embodiment, the developing roller 3 is disposed in contact with the surface of the photoconductor drum 1.

Figure 2A:
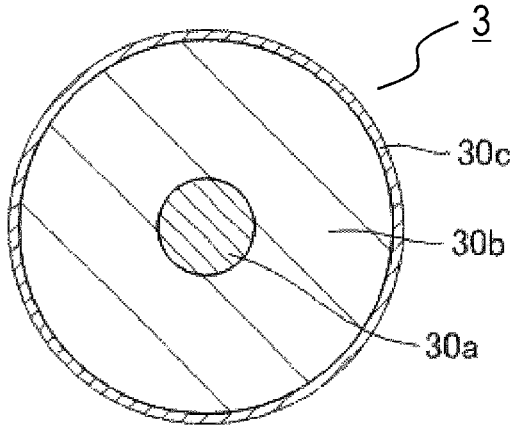
FIGS. 2A to 2C are schematic diagrams illustrating a configuration of a developing roller in an embodiment of the present invention.
Figure 2B:
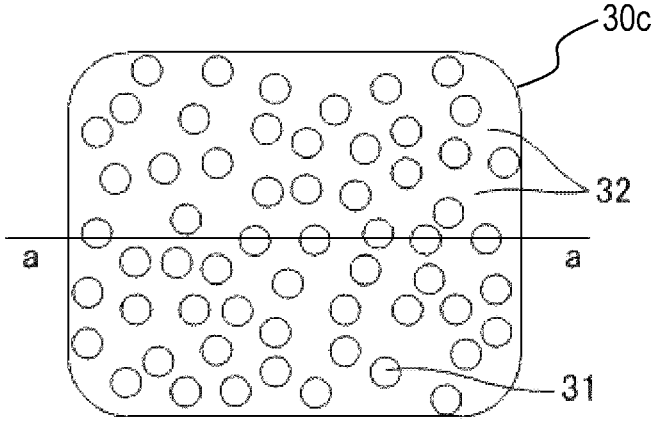
Figure 2C:
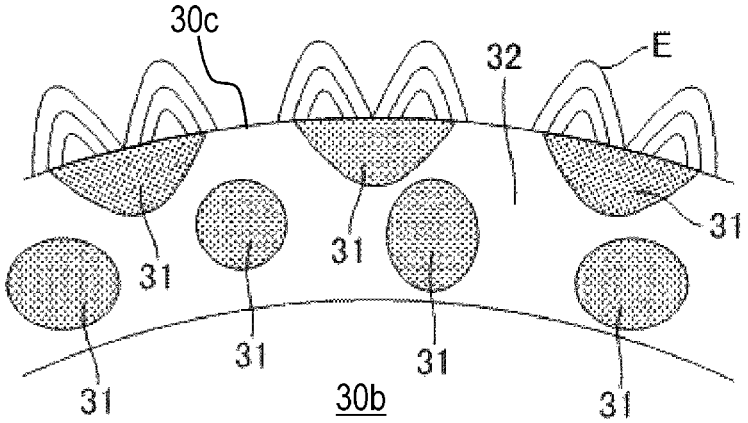

The developing roller 3 that is used in the present embodiment will be explained next in detail with reference to FIGS. 2A to 2C. As the developing roller 3 of the present embodiment there is used a developing roller in which the surface for carrying the toner 5 has a configuration wherein a plurality of dielectric portions, of small surface area and capable of holding charge, are interspersed and exposed on a surface that is formed of a conductor portion. Specifically the developing roller 3 is configured by having an elastic layer 30*b* made of a conductive rubber material, and a surface layer 30*c*, on the outer periphery of a shaft core 30*a*, as illustrated in FIG. 2A, which is a schematic cross-sectional diagram of the developing roller 3. The developing roller 3 can be produced by forming, for instance by coating, the surface layer 30*c* made of a conductive resin material and having dielectric particles dispersed therein, on the elastic layer 30*b*, and then polishing the surface of the surface layer 30*c*. FIG. 2B depicts a plan-view diagram of the surface layer 30*c* of the developing roller 3, and FIG. 2C depicts a cross-sectional diagram (a-a) of FIG. 2B. Small closed electric fields (micro-fields), as denoted by the electric lines of force E in FIG. 2C, become formed through charging of the dielectric portions 31 in accordance with a predetermined method.

The size of the dielectric portions 31 (size of the portions (circular portions) exposed at the peripheral face of the developing roller 3 (conductor portion 32)) is set for instance to an outer diameter in the range of about 5 to 500 μm. This size is an optimal value in order to hold charge on the surface and suppress image unevenness. When the outer diameter is smaller than 5 μm, the amount of potential that is held on the surface of the dielectric portions 31 decreases, and sufficient small closed electric fields cannot be formed. When the outer diameter is greater than 500 μm, the potential difference between the dielectric portions 31 and the conductor portion 32 increases, which results in images of significant unevenness.

To form a surface layer 30*c* such as the one illustrated in FIGS. 2A to 2C, for instance acrylic resin particles are dispersed in a urethane resin, as a binder. Carbon black or an ion conductive substance can be used as the conductive substance that is utilized in order to impart conductivity to the surface layer 30*c*. In the present embodiment, the urethane resin portion is made to function as the conductor portion 32, by setting the content of the conductive substance of the surface layer 30*c* to 0.20 parts by mass with respect to 100 parts by mass of the urethane resin. Acrylic resin particles having an average particle size of 30 μm are used in the dielectric portions 31. In the present embodiment, the content of the acrylic resin particles is set to 70 parts by mass with respect to 100 parts by mass of the urethane resin; as a result, the surface area of the dielectric portions 31, as a surface area ratio of dielectric portions 31/conductor portion 32, takes on a value of about 50% of the total.

Figure 3:
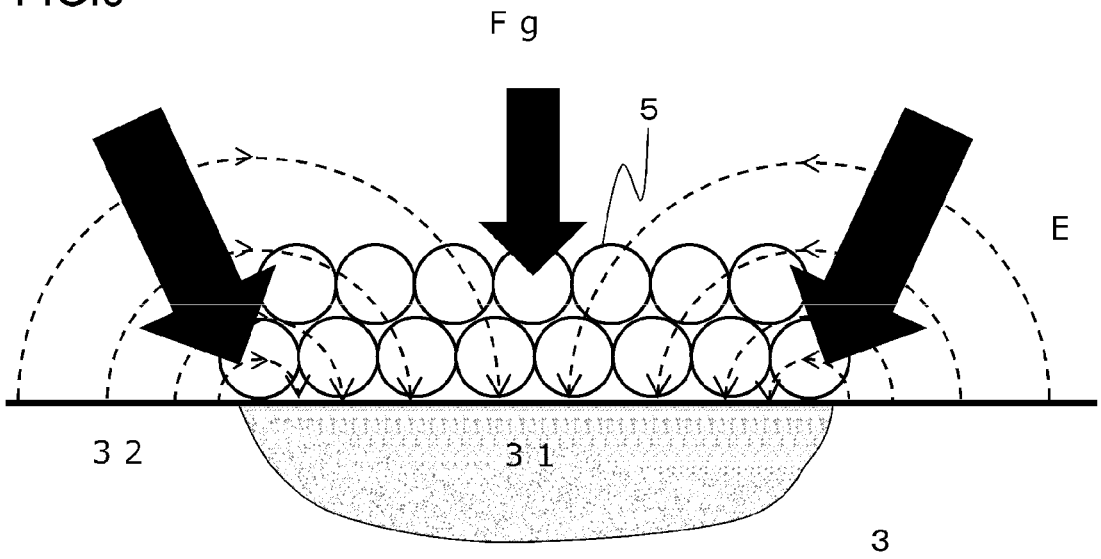
FIG. 3 is an explanatory diagram of the effect of gradient forces in an embodiment of the present invention.

FIG. 3 is a schematic diagram for explaining the effect of gradient forces that are generated on the surface of the developing roller 3. The image forming apparatus according to the present embodiment has a configuration wherein a toner feed/stripping member, such as a conventional one, is omitted in the developing apparatus, and wherein gradient forces are generated by the above-described micro-fields, in order to hold multiple layers of the toner 5 on the surface of the developing roller 3. As illustrated in FIG. 3, the dielectric portions 31 and the conductor portion 32 are provided on the surface of the developing roller 3, and the dielectric portions 31 are charged through rubbing by the developing blade 4, across the toner 5, whereupon small closed electric fields denoted by the dashed lines E are formed on portions adjacent to the conductor portion 32. Through the action of gradient forces Fg thus generated by the small electric fields, the toner 5 is attracted onto the surface of the developing roller 3, and is carried thereon.

Figure 4:
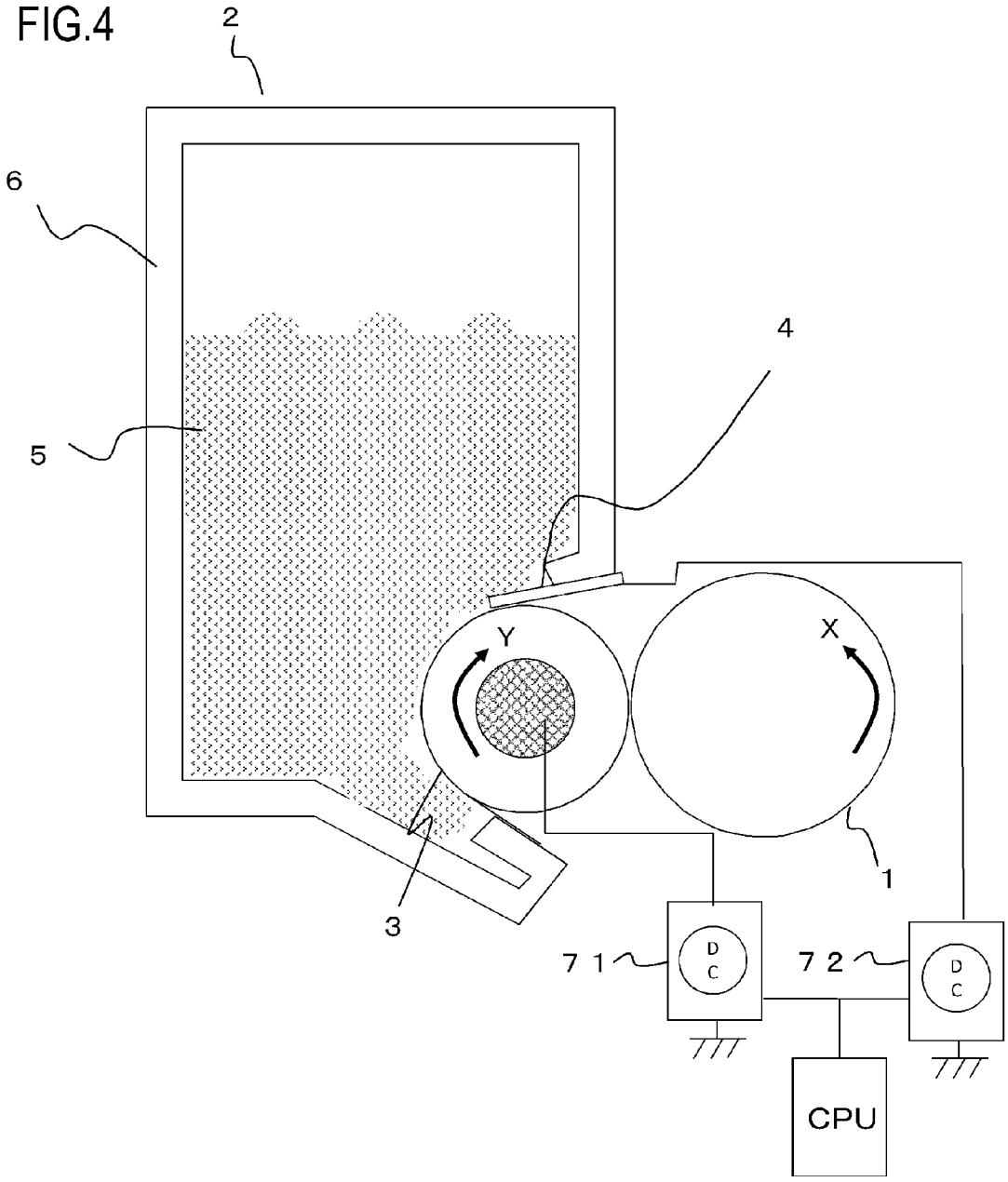
FIG. 4 is a schematic cross-sectional diagram of a developing apparatus according to an embodiment of the present invention.

FIG. 4 is a schematic cross-sectional diagram illustrating the schematic configuration of the developing apparatus 2 according to an embodiment of the present invention. FIG. 4 illustrates a bias supply configuration in the developing blade 4 and the developing roller 3. In the present embodiment, developing bias can be applied from a DC power source 71 to the developing roller 3, and blade bias can be applied from the DC power source 72 to the developing blade 4, as illustrated in FIG. 4. The magnitude of the bias (voltage) that the DC power sources 71, 72 apply to the developing roller 3 and the developing blade 4 is controlled by a CPU that controls the various operations of the image forming apparatus. The configuration pertaining to bias application corresponds to the voltage applying unit in the present invention.

Figure 5A:
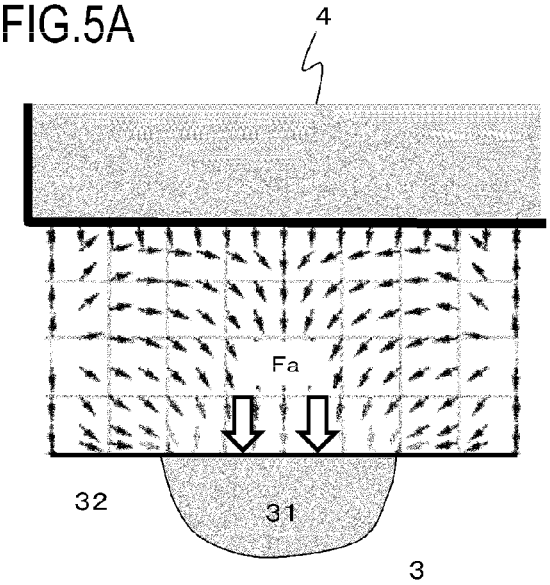
FIGS. 5A and 5B are explanatory diagrams of a relationship between applied bias and gradient forces in an embodiment of the present invention.
Figure 5B:
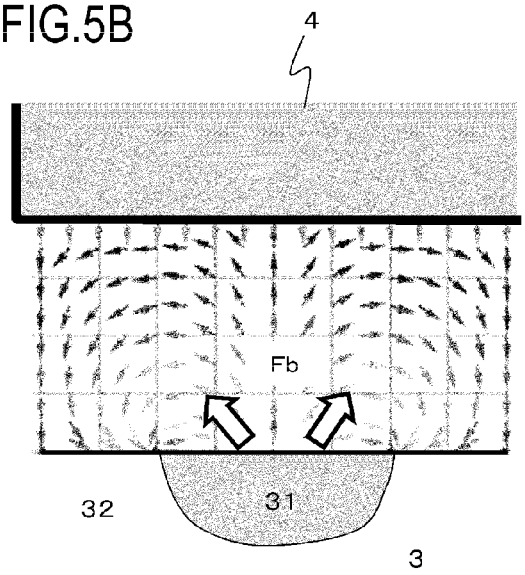

It has been found that the above gradient forces are influenced by blade bias in the vicinity of the region at which the developing roller 3 and the developing blade 4 are close to each other (in the vicinity of a regulation region at which the developing blade 4 regulates the layer thickness of the toner 5 that is carried on the developing roller 3). Specifically, it has been found that the magnitude and orientation of the attraction force of toner onto the surface of the developing roller 3 by the gradient forces vary depending on the potential difference between the developing roller 3 and the developing blade 4. This relationship will be explained with reference to FIGS. 5A and 5B. FIGS. 5A and 5B are schematic diagrams illustrating how gradient forces act around the region at which the developing roller 3 and the developing blade 4 come close to each other. FIGS. 5A and 5B depict graphically gradient forces having been worked out through calculation on the basis of the results of the electric field simulation. Gradient forces are denoted by arrows, in a state where the developing bias and the blade bias are at same potential (potential difference is zero), in FIG. 5A, and in a state where the developing bias and the blade bias exhibit a potential difference, in FIG. 5B. The orientation of the arrows denotes the orientation in which the gradient forces act, and the shading of the arrows denotes the strength of the forces (the darker the arrows, the stronger the forces).

As illustrated in FIG. 5A, the gradient forces generated when the developing roller 3 and the developing blade 4 are at a same potential act most strongly in a direction of attraction towards the developing roller 3, as denoted by arrows Fa. As illustrated in FIG. 5B, by contrast, the gradient forces in the direction of attraction towards the developing roller 3 are weaker, as denoted by arrows Fb, when there is a potential difference between the developing roller 3 and the developing blade 4 than when the developing roller 3 and the developing blade 4 are at a same potential. Forces acting rather in the direction of drawing away from the developing roller 3 arise instead, as gradient forces, at the dielectric portions 31. The forces that attract the toner towards the dielectric portions 31 are strongest when the developing roller 3 and the developing blade 4 are at a same potential; conversely, the attracting forces become weaker through imparting of a potential difference, on the downstream side of the vicinity of the nip that constitutes a proximity portion between the developing roller 3 and the developing blade 4.

In Embodiment 1, therefore, the above characteristic has been exploited to control developing bias and blade bias in such a manner so as to refresh the surface of the developing roller 3. Specifically, the developing roller 3 is rotationally driven with the developing bias and the blade bias at a same potential (zero potential difference), during image formation, in order to increase the toner supply amount, and with a predetermined potential difference between the developing bias and the blade bias during non-image formation (for instance, during post-rotation)

Figure 6A:
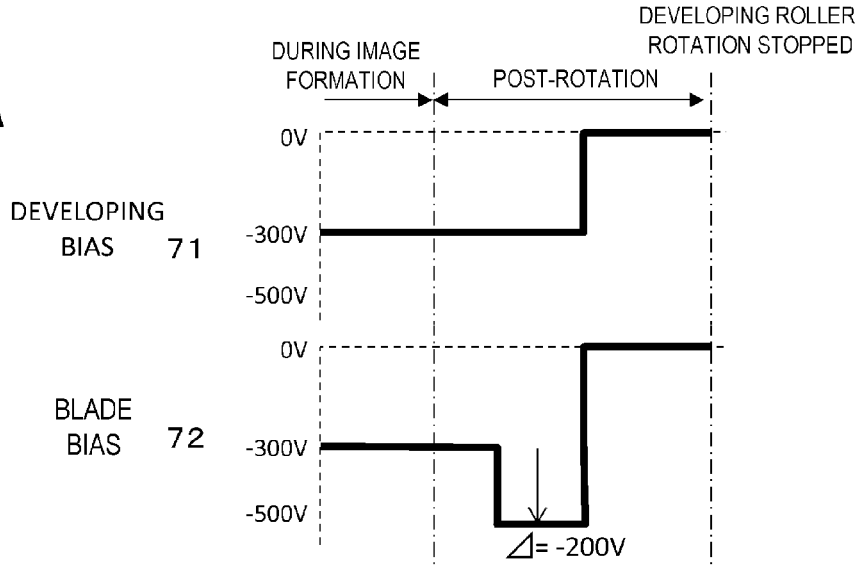
FIGS. 6A to 6C are explanatory diagrams of developing bias and blade bias in Embodiment 1 of the present invention.
Figure 6B:
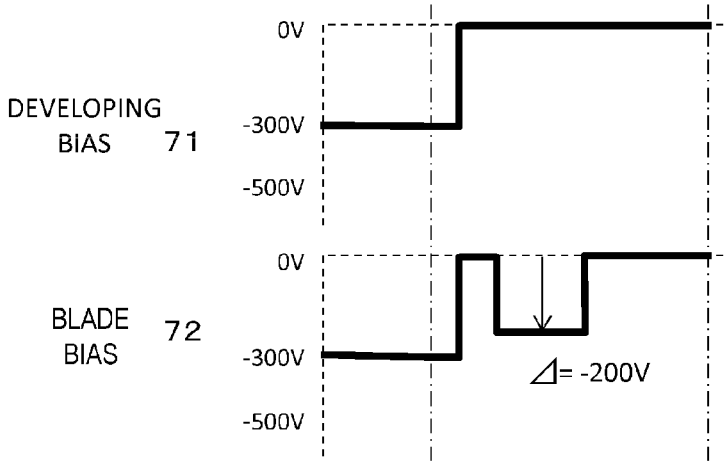
Figure 6C:
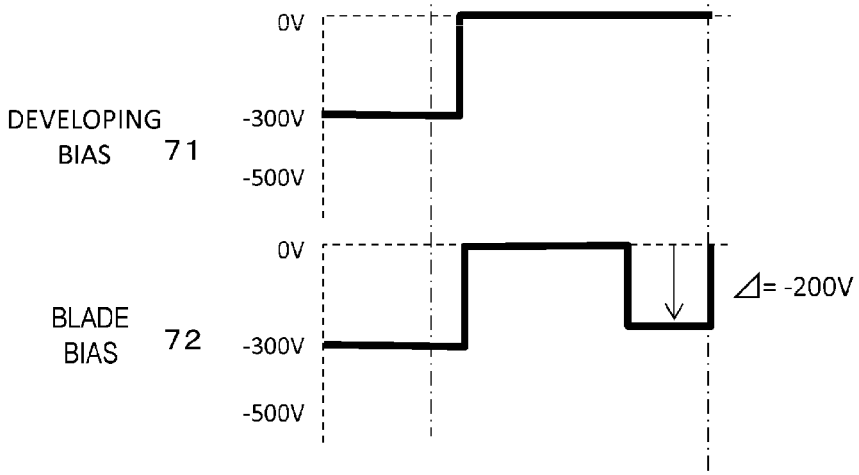

FIGS. 6A to 6C are explanatory diagrams of bias control in the present embodiment, illustrating, as examples, three control methods. In the example illustrated in FIG. 6A, DC −300 V of developing bias for contact development were applied to the developing roller 3, and a latent image design was imparted to the photoconductor drum 1 such that solid white image areas were at −500 V and solid image areas were at −100 V, during image formation. Further, DC −300 V of blade bias during image formation were applied, similarly to the case of the developing roller 3. In post-rotation, being part of non-image formation, an operation was carried out wherein blade bias was set to −500 V for a developing bias of −300 V, such that bias imparted accordingly with a potential difference of $\Delta=-200$ V was applied over a certain period of time, after which rotation was stopped.

In the image forming apparatus of FIG. 1 in the present embodiment, image formation was performed for 5000 prints at a low printing rate of small consumption of toner on the developing roller, i.e., of small turnover of toner on the developing roller, as a stringent condition for toner melt adhesion. The above-described bias control was performed during post-rotation, after image formation was over up to complete discontinuation of the operation of the developing roller 3 and so forth. Good images free of image defects were obtained as a result. A check of the surface of the developing roller 3 after image formation revealed no toner fixation or melt adhesion.

The way in which the post-rotation potential difference is imparted may involve setting temporarily each bias to 0 V, and imparting thereafter a potential difference, as illustrated in FIG. 6B, or setting temporarily each bias to 0 V, and thereafter discontinuing the rotation of the developing roller while that potential difference is being applied, as illustrated in FIG. 6C. Either control scheme elicits the same effects as that in the instance of FIG. 6A.

During non-image formation, specifically, bias control is executed that involves applying, to at least one from among the developing roller 3 and the developing blade 4, for a certain period of time, voltage such that the absolute value of the potential difference between the voltage applied to the developing roller 3 and the voltage applied to the developing blade 4 takes on a magnitude greater than that during image formation. This bias application control continues for at least the lapse of time during which a region where the developing roller 3 and the developing blade 4 that move relatively to each other by rotation of the developing roller 3 come close to each other (namely, the regulation region) passes over the entire area of the toner carrying surface of the developing roller 3. As a result, a force of stripping toner 5 off the toner carrying surface is applied onto the entire area of the toner carrying surface of the developing roller 3, and it becomes possible to suppress melt adhesion of the toner 5 at the surface of the developing roller 3.

As an example of bias control in the present embodiment, the magnitude (absolute value) of either one of developing bias and blade bias was increased, in such a manner that the potential difference took on a predetermined magnitude, only during the above period, as illustrated in FIG. 6A. In the above control scheme, the timing at which the magnitude of one of the biases is modified is set to a timing (second timing) that is matched to the timing (first timing) at which each bias is finally turned off in post-rotation, and that precedes this first timing by the above period. In the present embodiment the blade bias is modified, but a configuration may be resorted to wherein a potential difference of a predetermined magnitude is formed by modifying the developing bias. In the present embodiment, the magnitude of the potential difference is set to −200 V, but is not limited to a particular value, since the optimal value for suppressing toner melt adhesion may vary depending on, for instance, the configuration of individual apparatuses.

As another example of bias control in the present embodiment, each bias is temporarily turned off, and thereafter either one of the biases is applied during the above period, after which that one bias as well is turned off, as illustrated in FIGS. 6B, 6C. That is, one of the biases is applied, and the other is not, over the period during which the above potential difference is to be formed. The magnitude of the bias that is applied is set to a magnitude such that the above potential difference is formed. In the present embodiment, the magnitude of the applied bias is controlled by modifying blade bias, but a potential difference of a predetermined magnitude may be formed by modifying the developing bias.

To suppress toner melt adhesion at the surface of the developing roller 3, it is important, as described above, that the developing roller 3 be rotationally driven with a potential difference being provided between the developing bias and blade bias during post-rotation, to refresh the toner on the developing roller 3 on a regular basis. More specifically, it is important to refresh regularly the toner on the dielectric portions 31 at which a particularly strong attraction forces are generated during image formation. The occurrence of toner melt adhesion is suppressed as a result, and it becomes possible to preserve good image formation.

In the present embodiment, the timing at which the above potential difference for refreshing the developing roller 3 is provided is set within the course of the post-rotation operation, but may be set within the course of the operation before image formation. However, the occurrence of ghosting and solid image tracking defects can be suppressed through setting of the biases, for at least one rotation of the developing roller before image formation, to exhibit a potential difference that is smaller than the predetermined potential difference at the time of refreshing of the developing roller 3 during non-image formation.

The present embodiment allows thus providing a long-life image forming apparatus in which toner melt adhesion on the developing roller is ameliorated, while ameliorating ghosting and solid image tracking defects, in a developing apparatus from which a developer feed/stripping member has been omitted.

Embodiment 2

Figure 7A:
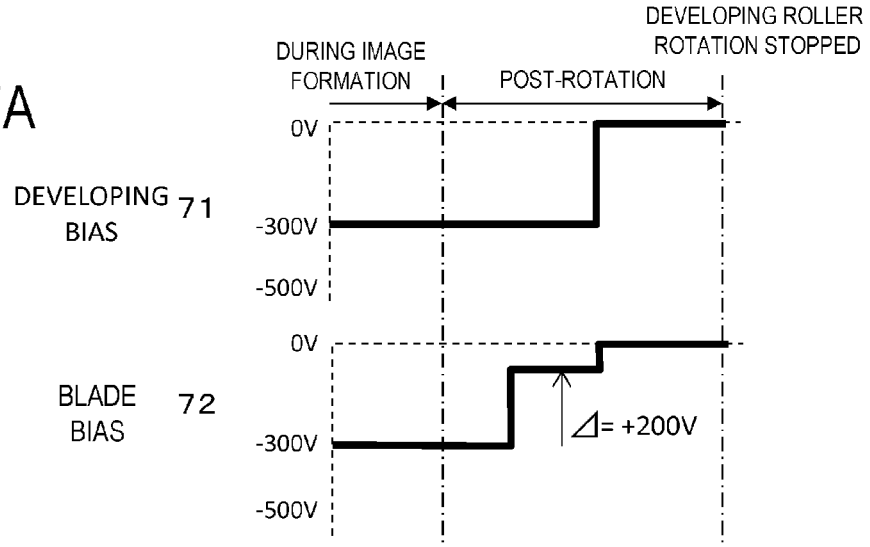
FIGS. 7A to 7C are explanatory diagrams of developing bias and blade bias in Embodiment 2 of the present invention.
Figure 7B:
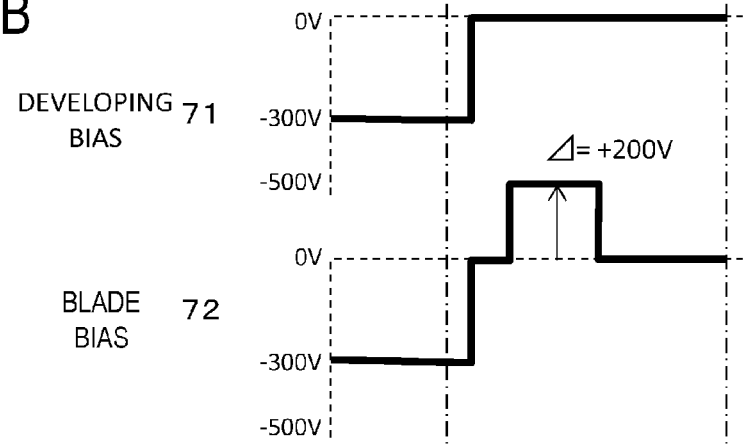
Figure 7C:
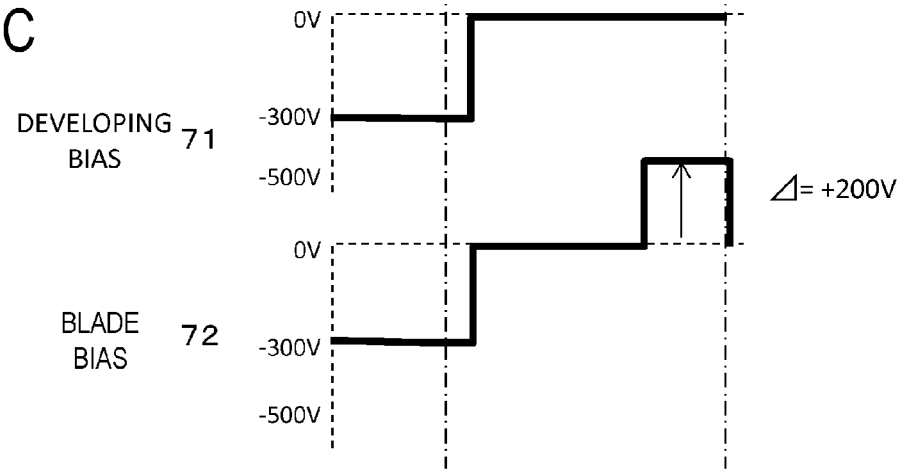

An image forming apparatus according to Embodiment 2 of the present invention will be explained next with reference to FIGS. 7A to 7C. Herein there will be mainly explained only features that differ from those of Embodiment 1. Configuration elements identical to those of Embodiment 1 will be denoted by identical reference symbols, and an explanation thereof will be omitted. Features that are not explained here are thus identical to those of Embodiment 1. FIGS. 7A to 7C are explanatory diagrams of bias control in the present embodiment, illustrating, as examples, three control methods. As illustrated in FIGS. 7A to 7C, bias control is identical to that of Embodiment 1, but herein the blade bias exhibits a positive potential difference with respect to the developing bias during the post-rotation operation In bias control illustrated in FIG. 7A, DC −300 V for contact development were applied to the developing roller 3, and a latent image design was applied to the photoconductor drum 1 such that solid white image areas were at −500 V and solid image areas were at −100 V, during image formation. Further, DC −300 V of blade bias during image formation were applied, similarly to the case of the developing roller 3. In post-rotation, being part of non-image formation, an operation was carried out wherein blade bias was set to −100 V for a developing bias of −300 V, such that bias imparted accordingly with a potential difference of +200 V was applied over a certain period of time, after which rotation was stopped.

In the image forming apparatus of FIG. 1 in the present embodiment, image formation was performed for 5000 prints at a low printing rate of small consumption of toner on the developing roller i.e. of small turnover of toner on the developing roller, as a stringent condition for toner melt adhesion. The above-described bias control was performed during post-rotation, after image formation was over up to complete discontinuation of the operation of the developing roller 3 and so forth. Good images free of image defects were obtained as a result. A check of the surface of the developing roller 3 after image formation revealed no toner fixation or melt adhesion. However, observation of the developing blade 4 after the printing operation revealed slight toner fixation. This can be attributed to the fact that, since the toner used herein has negative polarity, the toner is attracted to the developing blade 4 having a positive potential difference with a polarity opposite to the charging polarity.

The way in which a post-rotation potential difference is imparted may involve setting temporarily each bias to 0 V, and imparting thereafter a potential difference, as illustrated in FIG. 7B, or setting temporarily each bias to 0 V, and thereafter discontinuing the rotation of the developing roller while that potential difference is being applied, as illustrated in FIG. 7C. Either control scheme elicits the same effects as that in the instance of FIG. 7A.

Thus, Embodiment 2 as well allows providing a long-life image forming apparatus in which toner melt adhesion on the developing roller is ameliorated, while ameliorating ghosting and solid image tracking defects, in a developing apparatus from which a developer feed/stripping member has been omitted. Regarding the polarity of the potential difference, it is more preferable to impart a potential difference of the same polarity as that of the charging polarity of the toner, as in Embodiment 1.

Embodiment 3

Figure 8A:
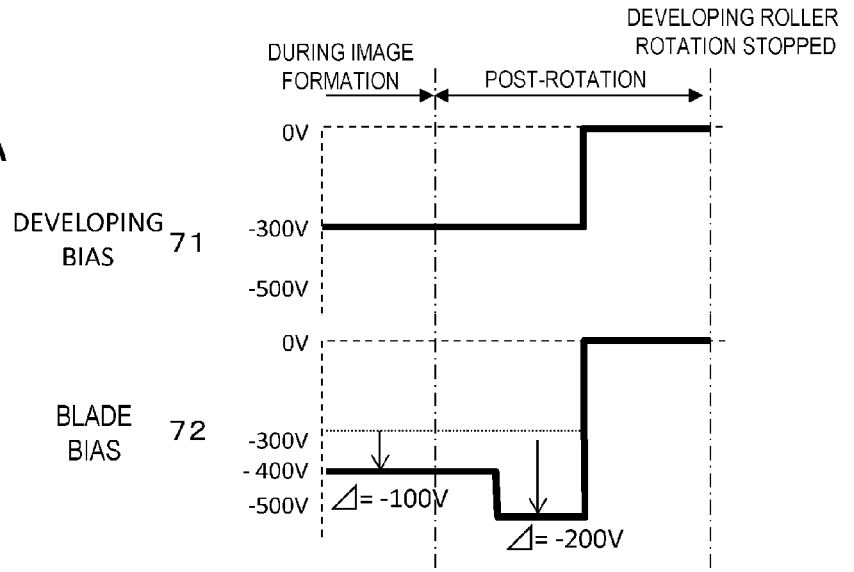
FIGS. 8A to 8C are explanatory diagrams of developing bias and blade bias in Embodiment 3 of the present invention.
Figure 8B:
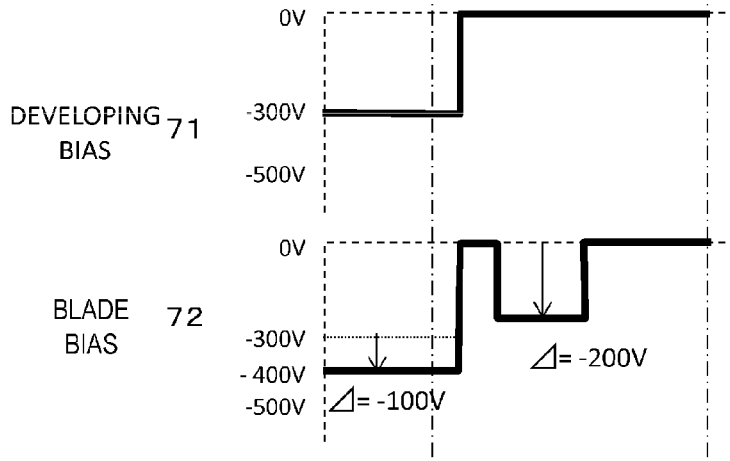
Figure 8C:
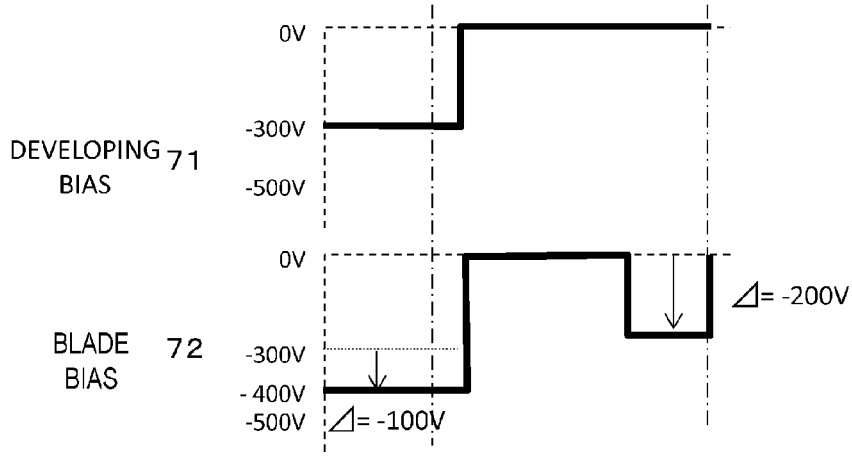

An image forming apparatus according to Embodiment 3 of the present invention will be explained next with reference to FIGS. 8A to 8C. Herein there will be mainly explained only features that differ from those of Embodiments 1 and 2. Configuration elements identical to those of Embodiments 1 and 2 will be denoted by identical reference symbols, and an explanation thereof will be omitted. Features that are not explained here are thus identical to those of Embodiments 1 and 2. FIGS. 8A to 8C are explanatory diagrams of bias control in the present embodiment, illustrating, as examples, three control methods.

In Embodiment 3, as illustrated in FIG. 8A, DC −300 V for contact development were applied to the developing roller 3, and a latent image design was imparted to the photoconductor drum 1 such that solid white image areas were at −500 V and solid image areas were at −100 V, during image formation. Further, −400 V of blade bias during image formation were applied, which amounted to a potential difference of −100 V with respect to the developing roller 3. In post-rotation, being part of non-image formation, an operation was carried out wherein blade bias of −500 V, amounting to a potential difference of −200 V with respect to the developing bias of −300 V, was applied over a certain period of time, after which rotation was stopped. In Embodiments 1 and 2, the developing bias and blade bias during image formation were set to the same potential, but in Embodiment 3, the potentials imparted to the developing bias and the blade bias during image formation were not identical potentials; instead, the developing bias and the blade bias were set to at least potentials that exhibited a potential difference smaller than that during non-image formation.

In the image forming apparatus of the present embodiment, image formation was performed for 5000 prints at a low printing rate of small consumption of toner on the developing roller i.e. of small turnover of toner on the developing roller, as a stringent condition for toner melt adhesion. The above-described bias control was performed during post-rotation, after image formation was over up to complete discontinuation of the operation of the developing roller 3 and so forth. Good images free of image defects were obtained as a result. A check of the surface of the developing roller 3 after image formation revealed no toner fixation or melt adhesion.

The way in which a post-rotation potential difference is imparted may involve setting temporarily each bias to 0 V, and imparting thereafter a potential difference, as illustrated in FIG. 8B, or setting temporarily each bias to 0 V, and thereafter discontinuing the rotation of the developing roller while that potential difference is being applied, as illustrated in FIG. 8C. Either control scheme elicits the same effects as that in the instance of FIG. 8A.

Comparative Example 1

As a comparative example of the present embodiment, an instance was assessed wherein the developing bias 71 and the blade bias 72 were not imparted with a potential difference during post-rotation, as in Embodiments 1 to 3; instead, the developing bias 71 and the blade bias 72 were set to the same potential throughout the rotation operation of the photoconductor drum. In the image forming apparatus of FIG. 1 in the present comparative example, image formation was performed for 5000 prints at a low printing rate of small consumption of toner on the developing roller i.e. of small turnover of toner on the developing roller, as a stringent condition for toner melt adhesion. The results revealed image defects caused by toner melt adhesion.

Comparative Example 2

As yet another comparative example of the present invention, an instance was assessed where the developing bias 71 during image formation was set to −300 V, and the blade bias 72 to −600 V, i.e. there was set a potential difference of −300 V. A solid image was printed using the image forming apparatus of FIG. 1 in the present comparative example, but the necessary continuous toner coat on the developing roller could not be obtained, and solid image tracking defects occurred in that the density at the trailing end of the image dropped.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-176947, filed Sep. 1, 2014, which is hereby incorporated by reference herein in its entirety.

What is claimed is:

1. An image forming apparatus, comprising a developing apparatus including:

a container for storing a developer;

a developer carrier in which a surface that carries the developer is configured so that a plurality of dielectric portions are interspersed on a surface formed of a conductor portion; and a regulating member that regulates a layer thickness of the developer that is carried on the developer carrier, the image forming apparatus forming an image on a recording material by developing, using the developing apparatus, an electrostatic latent image formed on an image bearing member to yield a developer image, and transferring the developer image from the image bearing member to the recording material, the image forming apparatus further comprising:

a voltage applying unit for applying voltages to the developer carrier and the regulating member, wherein the voltage applying unit has a period, during non-image formation, over which voltages are applied to the developer carrier and the regulating member, with an absolute value of potential difference between the applied voltages being greater than the potential difference when a voltage is applied during image formation to at least one of the developer carrier and the regulating member, such that a force generated to attract the developer toward the developer carrier during non-image formation is weaker than that generated during image formation.

2. The image forming apparatus according to claim 1, wherein the developer carrier and the regulating member are configured to move relatively in such a manner that a regulation region, at which the developer carrying surface of the developer carrier and the regulating member come close to each other, passes over the entire area of the developer carrying surface, and the voltage applying unit continues the period for at least a lapse of time during which the regulation region passes over the entire area of the developer carrying surface as a result of the relative movement.

3. The image forming apparatus according to claim 1, wherein during the period, the voltage applying unit sets an absolute value of the voltage that is applied to either one of the developer carrier and the regulating member to be greater than an absolute value of the voltage applied to the other of the developer carrier and the regulating member, in such a manner that the absolute value of the potential difference is greater than that during image formation.

4. The image forming apparatus according to claim 1, wherein during the period, the voltage applying unit does not apply a voltage to either one of the developer carrier and the regulating member, and applies, to the other of the developer carrier and the regulating member, a voltage such that the absolute value of the potential difference is greater than that during image formation.

5. The image forming apparatus according to claim 2, wherein during non-image formation and at a second timing that precedes, by at least the lapse of time during which the regulation region passes over the entire area of the developer carrying surface as a result of the relative movement, a first timing at which the voltage that is applied to either one of the developer carrier and the regulating member is turned off, the voltage applying unit modifies the voltage that is applied to the other of the developer carrier and the regulating member in such a manner that the absolute value of the potential difference is greater than that during image formation, and, at the first timing, turns off the voltage that is applied to the other.

6. The image forming apparatus according to claim 2, wherein during non-image formation, the voltage applying unit turns off the voltage that is applied to the developer carrier and the regulating member, and thereafter applies, to either one of the developer carrier and the regulating member, a voltage such that the absolute value of the potential difference is greater than that during image formation for at least the lapse of time during which the regulation region passes over the entire area of the developer carrying surface as a result of the relative movement.

7. The image forming apparatus according to claim 1, wherein a polarity of the potential difference in the period is identical to a charging polarity of the developer.

8. The image forming apparatus according to claim 1, wherein a polarity of the potential difference in the period is opposite to a charging polarity of the developer.

9. The image forming apparatus according to claim 1, wherein the potential difference during image formation is zero.

10. The image forming apparatus according to claim 1, wherein a polarity of the potential difference during image formation and a polarity of the potential difference in the period are identical.

11. An image forming apparatus, comprising a developing apparatus including:

a container for storing a developer;

a developer carrier in which a surface that carries the developer is configured so that a plurality of dielectric portions are interspersed on a surface formed of a conductor portion; and a regulating member that regulates a layer thickness of the developer that is carried on the developer carrier, the image forming apparatus forming an image on a recording material by developing, using the developing apparatus, an electrostatic latent image formed on an image bearing member to yield a developer image, and transferring the developer image from the image bearing member to the recording material, the image forming apparatus further comprising:

a voltage applying unit for applying voltages to the developer carrier and the regulating member, wherein the voltage applying unit has a period, during non-image formation, over which voltages are applied to the developer carrier and the regulating member, with an absolute value of potential difference between the applied voltages being greater than the potential difference when a voltage is applied during image formation to at least one of the developer carrier and the regulating member, such that a force is generated to attract the developer to move toward the regulating member from the developer carrier during non-image formation.

* * * * *